US005922258A

United States Patent [19]

Bossetti

[11] Patent Number: 5,922,258

[45] Date of Patent: Jul. 13, 1999

[54] METHOD AND DEVICE FOR FORMING COMPLEX SANITARY FITTINGS

[75] Inventor: Renato Bossetti, Novara, Italy

[73] Assignee: S.I.T.A. S.p.A. Societa Impianti Termoelettrici Industriali, Italy

[21] Appl. No.: 08/930,477

[22] PCT Filed: Mar. 29, 1996

[86] PCT No.: PCT/EP96/01384

§ 371 Date: Sep. 29, 1997

§ 102(e) Date: Sep. 29, 1997

[87] PCT Pub. No.: WO96/31329

PCT Pub. Date: Oct. 10, 1996

[30] Foreign Application Priority Data

Apr. 4, 1995 [IT] Italy ..... MI95A0672

[51] Int. Cl.[6] ..... B28B 1/26

[52] U.S. Cl. ..... 264/86; 425/84

[58] Field of Search ..... 264/86, 87; 425/84, 425/85

[56] References Cited

U.S. PATENT DOCUMENTS

| | | | |
|---|---|---|---|
| 1,911,011 | 5/1933 | Brotz . | |
| 3,397,259 | 8/1968 | Arnold et al. | 264/86 |
| 4,528,152 | 7/1985 | Aoyama et al. | 264/87 |
| 4,798,525 | 1/1989 | Sato et al. | 264/86 |
| 4,867,662 | 9/1989 | Shimahara et al. | 264/87 |
| 4,882,111 | 11/1989 | Murata | 264/87 |
| 4,908,174 | 3/1990 | Will | 264/87 |
| 4,948,087 | 8/1990 | Hisaeda et al. | 264/86 |
| 5,069,609 | 12/1991 | Ito et al. | 264/86 |
| 5,120,211 | 6/1992 | Ito et al. | 264/86 |
| 5,156,855 | 10/1992 | Hisatomi et al. | 264/86 |
| 5,183,668 | 2/1993 | Murato et al. | 264/86 |
| 5,591,387 | 1/1997 | Takeuchi et al. | 264/86 |
| 5,662,944 | 9/1997 | Petrucco | 264/86 |
| 5,741,388 | 4/1998 | Gerster et al. | 264/86 |

FOREIGN PATENT DOCUMENTS

| | | | |
|---|---|---|---|
| 5026 | 10/1979 | European Pat. Off. | 264/86 |
| 211653 | 2/1987 | European Pat. Off. | 264/87 |
| 317720 | 5/1989 | European Pat. Off. | 264/86 |
| 557995 | 9/1993 | European Pat. Off. | 264/86 |
| 2 028 059 | 12/1971 | Germany . | |

OTHER PUBLICATIONS

Patent Abstracts of Japan, Publication No. JP 5131411, vol. 17, No. 503, May 28, 1993.

Patent Abstracts of Japan, Publication No. JP 5131412, vol. 17, No. 503, May 28, 1993.

*Primary Examiner*—Karen Aftergut

*Attorney, Agent, or Firm*—R. Neil Sudol; Henry D. Coleman

[57] ABSTRACT

A method for forming complex-shaped sanitary fittings with a mold (10) that includes four parts (11, 12, 13, 14) made of porous resin capable of mutually self-centering by means of complementarily shaped locators (15), in which the method includes the following steps:

(a) closing the mold by means of a manual or robotized handling device (23) that has a relatively low force;

(b) inserting the closed mold inside a container (16) that has a relatively high force, and generating pressure on six faces of the mold (10);

(c) injecting a slip inside the mold (10);

(d) extracting the closed mold from the container (16);

(e) opening the mold (10).

13 Claims, 6 Drawing Sheets

METHOD AND DEVICE FOR FORMING COMPLEX SANITARY FITTINGS

BACKGROUND OF THE INVENTION

The present invention relates to a method for forming complex-shaped sanitary fittings with a mold that includes four parts made of porous resin, and to a device for performing the method.

The expression "complex-shaped sanitary fittings" describes sanitary fittings that cannot be formed with a mold constituted by only two parts: a typical example of complex-shaped sanitary fitting is the so-called bowl or water closet.

Methods and devices for forming complex-shaped sanitary fittings are known; they differ essentially in that they operate at ambient/low pressure or at high pressure.

The ambient- or low-pressure systems are based on the use of plaster molds formed by four or five parts that are capable of self-centering by means of complementarily shaped locators. Once the mold has been closed, a ceramic suspension of kaolin, clay, et cetera, specifically termed "slip", is introduced; this suspension tends to form a dense layer on the walls of the mold due to the absorption of moisture performed by capillarity from the plaster that forms the mold. When the layer on the walls of the mold is compact enough, after approximately one hour and a quarter, the excess slip is eliminated and the mold is opened and then left to dry overnight before being able to mold another part. The long drying is indispensable to allow the plaster to perform the essential function of absorbing moisture by capillarity. In practice, therefore, it is possible to mold only one part per day per mold. Furthermore, due to its nature, the plaster of the molds tends to deteriorate rather quickly, and therefore in practice a mold can produce only 80–100 sanitary fittings, after which it is unusable.

High-pressure systems are known. These systems are based on the use of molds made of porous resin of a well-known type. This resin has a much greater mechanical strength than plaster, and is capable of withstanding relatively high operating pressures, for example 5 to 20 bar. The mold parts are unable to self-center with complementarily shaped locators, since centering is entrusted to the actuators that support the mold parts. Accordingly, each mold part is stably fixed to an actuator of its own, which opens the mold for part extraction, closes it, and also provides the force required to keep the mold closed when the slip is injected under pressure. In this manner, the time required to form a dense layer on the walls of the mold is reduced to approximately 15 minutes, and it is also not necessary to dry the mold; accordingly, it is possible to perform one molding operation after the other without pauses. However, a slip injection pressure of 10 bar generates a force of several tons which tends to open the mold. Accordingly, the closing and opening actuators, each of which is connected to one of the four or five parts of the mold, must be sized so as to withstand a considerable stress with the greatest precision. In practice, the apparatus is very large, complicated, and expensive. Furthermore, changing the molds because of wear or to change the type of production is complicated, since in order to achieve the required closing precision the mating between each mold part and the corresponding actuator must be perfect. In particular, if the first two mold parts are not well-aligned, it is impossible to close the other two.

EP 540 004, discloses a molding flask mating mechanism. However this arrangement can support only four sides of the mold, but cannot support all six sides. So the remaining unsupported two sides are charged with the inner pressure, but cannot easily withstand it. Furthermore, the urging cylinders urge on the central area of the surface of each part of the mold. Such central area, however cannot support a large amount of stress because in this area the wall of the mold is generally relatively thin. Therefore the life span of the mold is dramatically reduced.

From EP 561 613 a moulding apparatus is known. This apparatus is based on inflatable means which act on the whole surface of each part of the mold. However with this arrangement it is impossible to prevent that a large amount of the stress is discharged, also in this case, on the central area of the surface of each part of the mold. Such central area, as above said, cannot support the stress and therefore the life span of the mold is dramatically reduced. Furthermore, the mold is arranged into a container that can be opened completely. This solution is expensive, requires a complicated adjustment and is not reliable as required.

From EP 2 602 452 a process for moulding ceramic articles is known. This process involves the use of a cylindric container filled with a liquid to provide an isostatic pressure. This solution is hydraulically very complicated for sealing problems, not only inside the cylinder (between said liquid and the inner part of the mold), but also outside (the cylinder requires two large covers that must support not only the mechanical stress, but also the hydraulic seal). Furthermore the process is very slow because each time the cylinder must be closed, filled with the liquid etc. Finally this solution is very expensive because the above mentioned sealing problems require expensive means.

BE-A-887 560 corresponding to Derwent AN 81-47856D discloses an arrangement for pressing isostatically ceramic powders with extremely high pressure up to 4000 bar or more. This arrangement is extremely expensive and unsuitable for the purposes of the present invention.

Accordingly, plaster molds are still widely used even though the method is extremely slow.

OBJECTS OF THE INVENTION

The aim of the present invention is to overcome the above mentioned drawbacks by providing a method and a device that allow to use molds made of porous resin and high pressure, but in an economically convenient manner, with a compact plant, and with simple installation and operation.

An object is to be able to produce two or more parts at a time.

Another object is to be able to change the type of mold very quickly.

Another object is to be able to extract toilet bowls from the mold on their footing or on their top as convenient.

Another object is to be able to manually correct any defects, before completing mold extraction, simply with a hand of slip.

Another object is to provide molds that are simpler, allowing to add parts, such as for example the water distribution ring in toilet bowls, to the partially open mold.

Another object is to be able to increase productivity also with respect to known methods that use porous-resin molds.

Another object is to maintain a long life and reliability of the molds.

SUMMARY OF THE INVENTION

This aim, these objects, and others are achieved by the method for forming complex-shaped sanitary fittings with a mold that includes four parts made of porous resin capable of mutually self-centering by means of complementarily shaped locators, in which the method includes the following steps:

(a) closing said mold by means of a manual or robotized handling device that has a relatively low force;

(b) inserting said closed mold inside a container that has a relatively high force, and generating pressure on six faces of said mold; said insertion being performed by lifting said mold;

(c) injecting a slip inside said mold;

(d) extracting said closed mold from said container; said extraction being performed by lowering said mold;

(e) opening said mold.

Preferably, the slip is injected inside the mold at a pressure above 4 bar, preferably above 8 bar.

The invention also relates to a device for forming complex-shaped sanitary fittings using a mold comprising four parts made of porous resin and provided with complementarily shaped locators facilitating proper alignment of the four parts relative to one another. The device comprises a container that is suitable to generate pressure on six faces of the mold after a closure thereof, a conveyor for bringing together the container and the closed mold so that the closed mold is insertable inside the container, and multiple independent actuators for the container. Each of the actuators is provided with a plate that is large enough to substantially cover a respective face of the closed mold. The plate is connected with the respective actuator by a joint that allow a certain degree of oscillation of the plate with respect to the container, so as to adapt a position of the plate to a position of the respective face of the closed mold.

BRIEF DESCRIPTION OF THE DRAWING

The invention will become apparent with reference to the drawings of an embodiment, which are enclosed by way of non-limitative example and wherein.

DESCRIPTION OF THE PREFERRED EMBODIMENT

Figure 1:
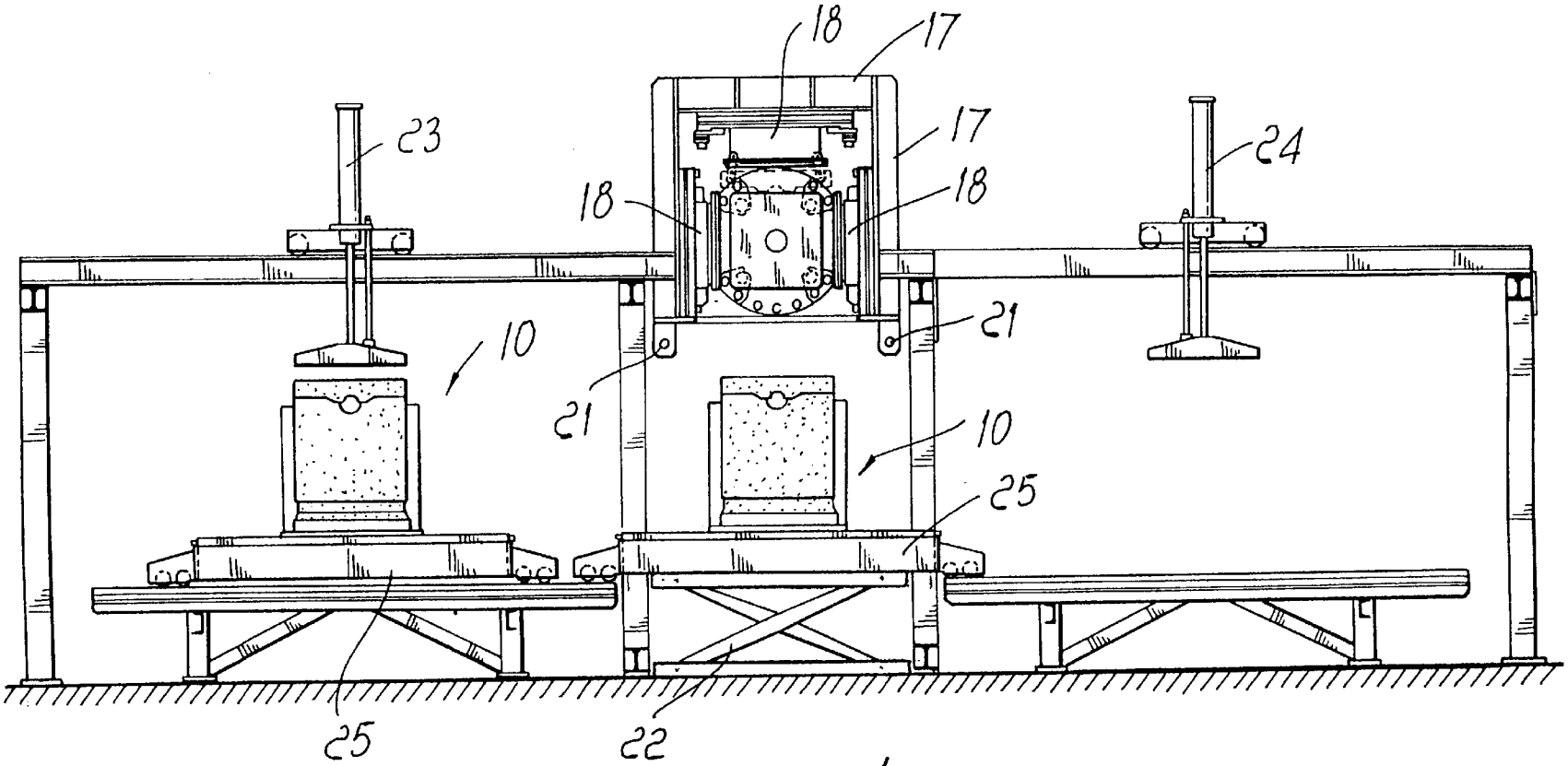
FIG. 1 is a side view of the device according to the invention.
Figure 2:
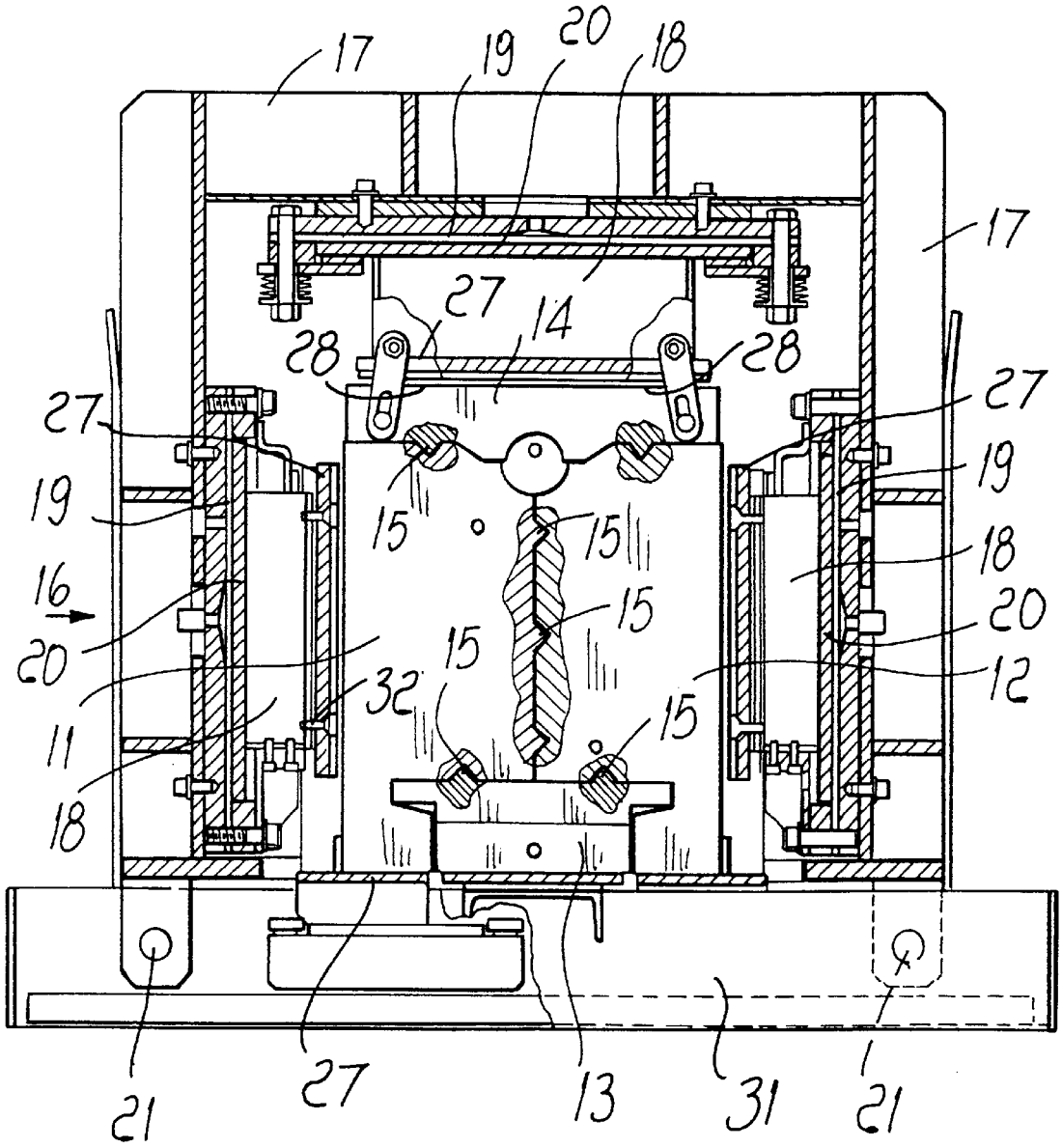
FIG. 2 is a side view of a detail of the device of FIG. 1.
Figure 3:
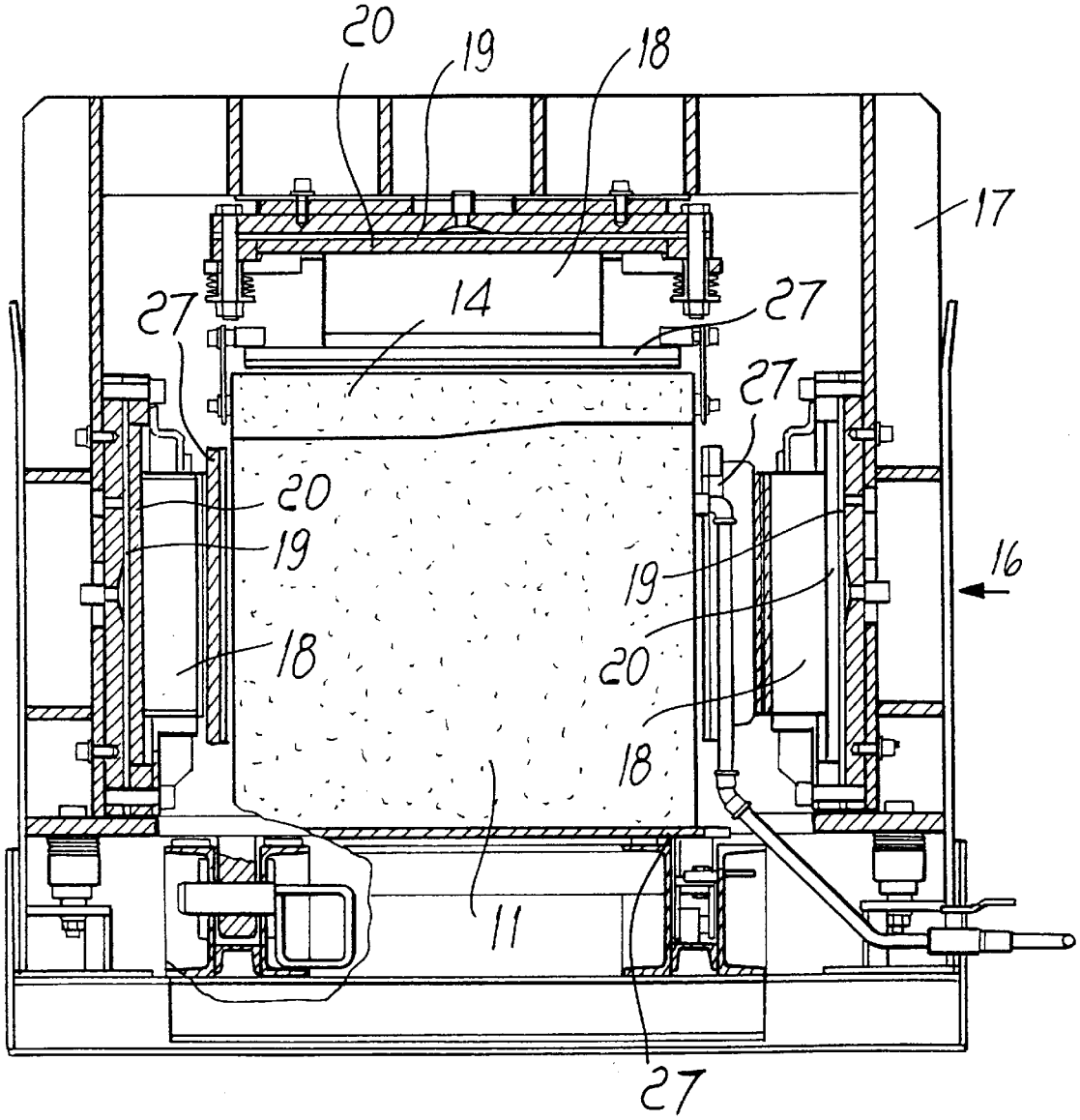
FIG. 3 is a front view of the detail of FIG. 2.
Figure 4:
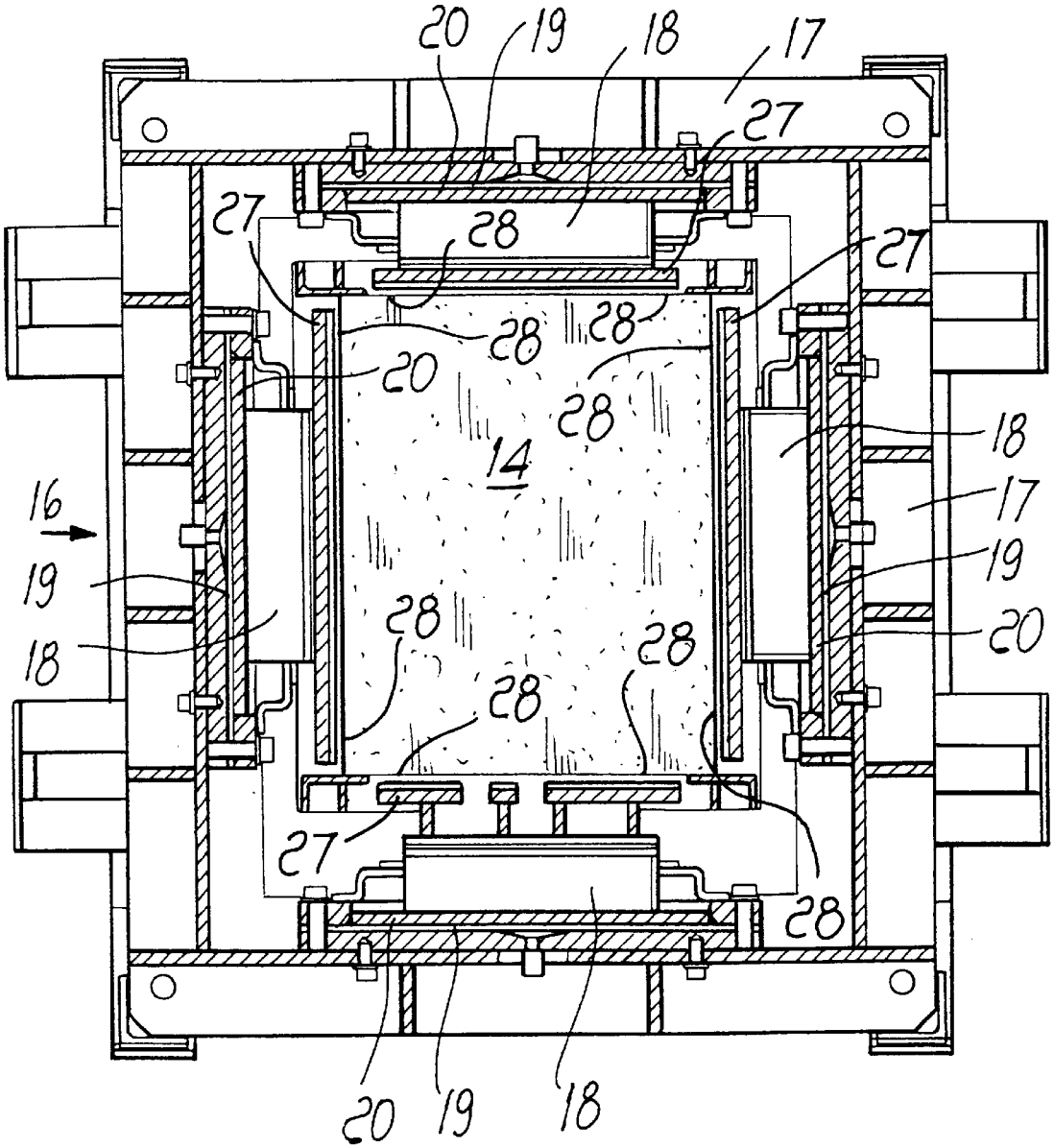
FIG. 4 is a plan view of the detail of FIG. 2.

With reference to FIGS. 1 to 7, the mold 10 is formed by the two lateral parts 11 and 12, by the bottom part 13, and by the covering part 14. The parts 11–14 are capable of mutually self-centering by means of the complementarily shaped locators 15.

The container 16 generates pressure on the six faces of the mold 10 and is formed by bars 16 and is provided with multiple actuators 18, namely five actuators 18. Each actuator 18 is provided with urging means 27 that can urge an area substantially on a margin 28 of one of said faces of the mold 10. The urging means comprise a plate 27 that is large enough to substantially cover a face of the mold 10.

The urging means 27 are connected with the actuator 18, 30 by connecting means 32 (FIGS. 1–4) or 29 (FIGS. 5–7) that allow a certain degree of oscillation of said urging means 27 with respect to the container 16, so as to adapt a position of the urging means 27 to a position of a face of the mold 10.

With particular reference to FIGS. 1 to 4, the degree of oscillation is allowed by the form of the actuators 18, that are of the membrane type. Particularly the connecting means may be the joints 32 that connect the plate 27 to the membrane actuator 18. Each actuator 18 is of the membrane type and includes in particular a membrane 19 that supports a disk 20. In this manner, the fluid that acts on the membrane pushes forward the membrane 19 and the disk 20, thus providing the force of many tons required to keep the mold closed. This particular embodiment of the actuator by means of a membrane offers the advantage of allowing the actuator to adapt automatically to the surface of the mold, which is usually rather uneven. Accordingly, even if the outside walls of the mold are not machined with great precision, the membrane actuators allow trouble-free automatic adaptation.

Figure 5:
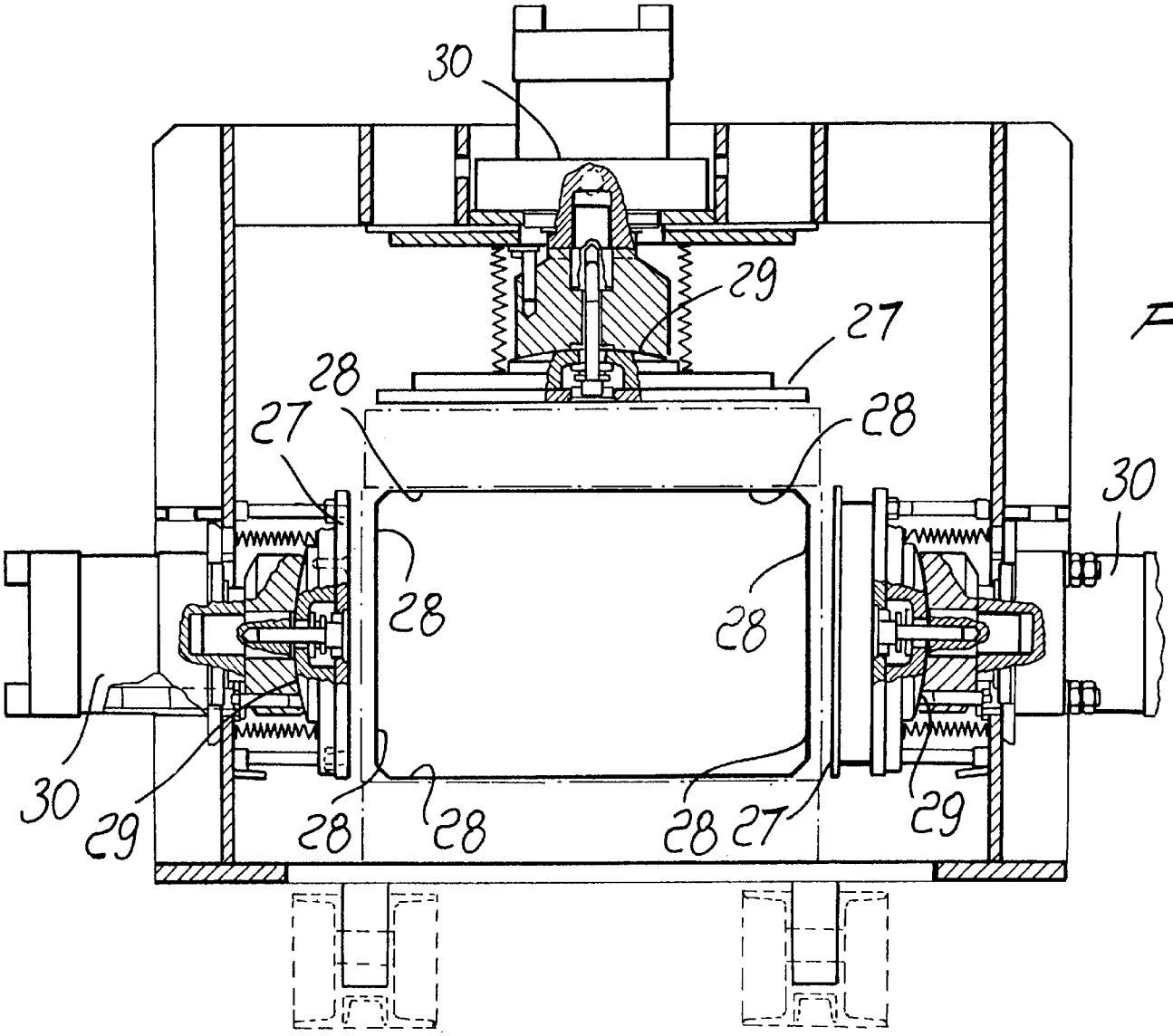
FIG. 5 is a front view of another embodiment of the device according to the invention.
Figure 6:
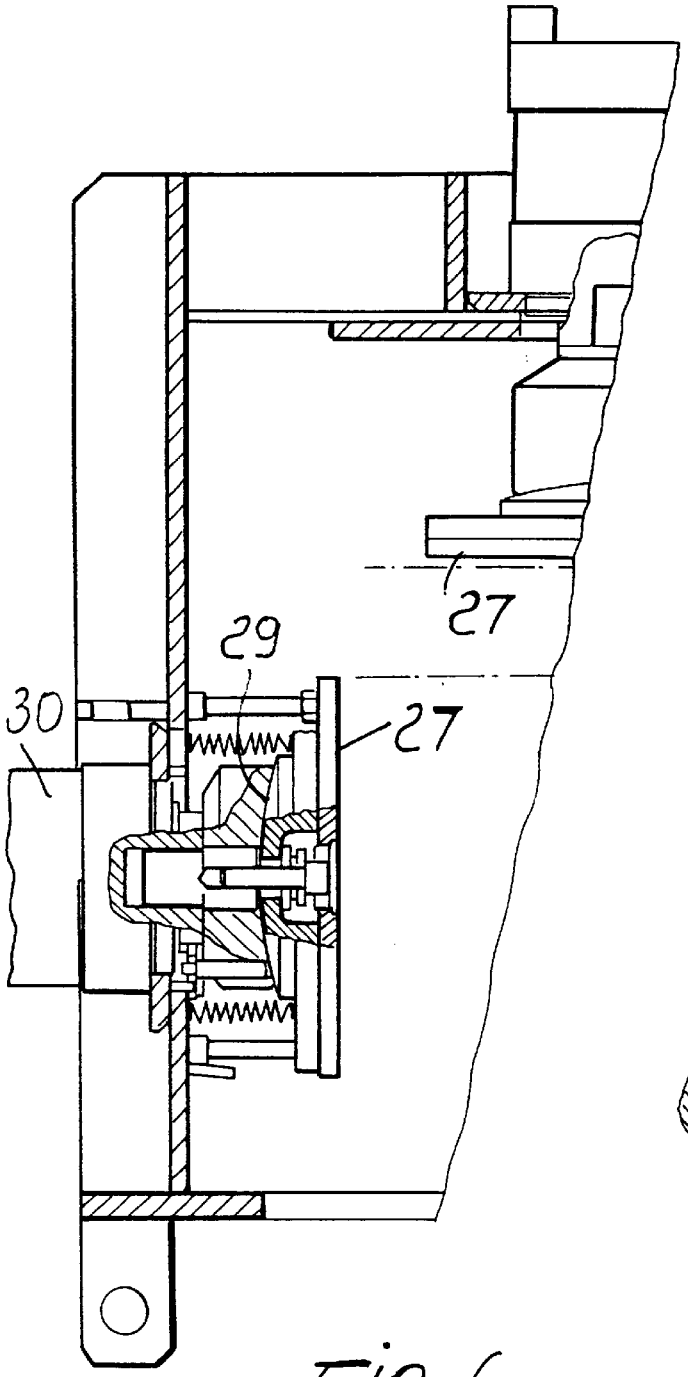
FIG. 6 is a side view of a particular of the device of FIG. 5.
Figure 7:
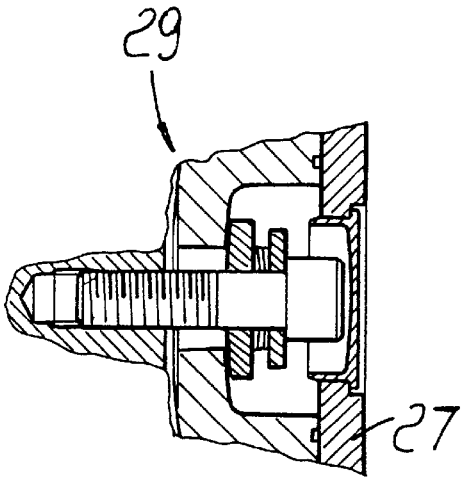
FIG. 7 is a side view of a particular of the device of FIG. 6.

With particular reference to FIGS. 5 to 7, which represent a preferred embodiment of the invention, the degree of oscillation is allowed by a spheric joint 29 that connects the urging means 27 with the actuator 30. This embodiment is preferred because it allows the use of piston-cylinder actuators that enable much higher pressures to be reached than is possible with membrane actuators.

With reference to FIGS. 1 to 7, the container 16 is shaped like a parallelepiped and has five welded and reinforced walls, as shown in the figures. The bottom wall can be opened and closed to introduce the closed mold 10. In particular, the bottom wall can be closed, ensuring the necessary closing force, by inserting pins in the holes 21.

A conveyor means 22 is provided and forms a pantograph lifting means to lift the closed mold 10 and insert it in the container 16.

The handling devices 23 and 24 are used to close and open the mold respectively before and after the injection of the slip under pressure.

With simple modifications, it is possible to widen the container 16 so as to be able to introduce two or more molds 10 simultaneously, in order to increase production.

Operation is as follows: first of all, the mold is closed with the handling device 23, then the carriage 25 is made to slide under the container 16. Then the pantograph 22 rises and inserts the closed mold 10 inside the container 16. The bottom wall of the container 16 is closed so that the pins enter the holes 21. Pressurized fluid is fed to the membranes 19 of the actuators 18, and the slip is injected under pressure into the mold. After approximately 15 minutes, the slip that has not adhered to the walls of the mold 10 is removed, the pantograph 22 is lowered, and the carriage 25 is moved to the right side of the device, with particular reference to FIG. 1. Then the mold is gradually opened (after optionally turning it over) with the handling device 24, so as to be able to correct any imperfections or add separately formed parts before the mold is completely extracted. At the same time, it is possible to introduce another mold 10 inside the container 16, so that while the slip forms the dense layer inside the new part, it is possible to take advantage of this time to extract the previous mold, clean the mold, and close it in preparation for a new molding operation. In this manner, the container 16 is used continuously and there are no downtimes for mold extraction, mold cleaning, closing, et cetera.

The method and device according to the invention are susceptible of numerous modifications and variations; thus, for example, it is possible to insert the mold in the container 16 by moving the container 16 instead of moving the mold 10. The handling devices can be of a different kind, either robotized or manual. With simple modifications, the actuators can be just three instead of five. In addition to its four main parts, the mold can have auxiliary parts: plugs, internal inserts, et cetera. Likewise, all the details may be replaced with other equivalent ones.

What is claimed is:

1. Method for forming complex-shaped sanitary fittings with a mold comprising four parts made of porous resin, said four parts being provided with complementarily shaped locators facilitating proper alignment of said four parts relative to one another, said method comprising the following steps:

(a) closing said mold by means of a manual or robotized first handling device that has a relatively low force;

(b) inserting the closed mold inside a container that has a relatively high force, and generating pressure on six faces of said closed mold, said inserting being performed by lifting said closed mold;

(c) injecting a slip inside said closed mold;

(d) extracting said closed mold from said container, said extracting being performed by lowering said closed mold;

(e) opening said closed mold with a second handling device;

(f) permitting said slip to form a dense layer inside said closed mold;

(g) extracting a molded piece from an additional mold;

(h) cleaning said additional mold; and (i) closing said additional mold in preparation of a new molding operation, at least part of said steps of extracting, cleaning and closing said additional mold being performed during said step of permitting.

2. Method according to claim 1, wherein said container is formed by a container provided with multiple independent actuators.

3. Method according to claim 2, wherein each of said actuators is provided with urging means that urge an area substantially on a margin of a face of said mold.

4. Method according to claim 1, wherein said slip is injected inside said mold at a pressure above 4 bar.

5. Device for forming complex-shaped sanitary fittings with a mold that comprises four parts made of porous resin and provided with complementarily shaped locators facilitating proper alignment of said four parts relative to one another, comprising:

a container that is suitable to generate pressure on six faces of said mold after a closure thereof and after insertion of said mold in said container;

conveyor means for bringing together said container and the closed mold so that said closed mold is insertable inside said container;

multiple independent actuators for said container, each of said actuators being provided with a plate that is large enough to substantially cover a respective face of said close mold, said plate being connected with the respective actuator by connecting means that allow a certain degree of oscillation of said plate with respect to said container, so as to adapt a position of said plate to a position of said respective face of said closed mold, said degree of oscillation being allowed by a joint that connects said plate with said respective actuator.

6. Device according to claim 5 which said joint is a spheric joint.

7. Device according to claim 5, wherein said container is provided with five actuators.

8. Device according to claim 5 in which said container is provided with an alternately openable and closable wall for enabling an insertion of said closed mold into said container and further enabling a subsequent removal of said closed mold from said container.

9. Device according to claim 5, wherein said container takes the form of a parallelepiped.

10. Device according to claim 5, wherein said conveyor means comprises a lifting means for lifting said closed mold and inserting said closed mold inside said container.

11. Device for forming complex-shaped sanitary fittings with a mold that comprises four parts made of porous resin and provided with complementarily shaped locators facilitating proper alignment of said four parts relative to one another, comprising:

a container generating pressure on six faces of said mold after a closure thereof and after insertion of said mold in said container;

conveyor means for bringing together said container and the closed mold so that said closed mold is insertable inside said container;

multiple independent actuators for said container, each of said actuators being provided with a plate that is large enough to substantially cover a respective face of said closed mold, said plate being connected with the respective actuator by a mechanical joint enabling a pivoting of said plate with respect to said container, so as to adapt a position of said plate to a position of said respective face of said closed mold; and at least two handling devices for closing said mold prior to an insertion thereof into said container and for opening said closed mold after removal thereof from said container, thereby enabling simultaneous preparation of a closed mold for insertion into said container and the formation of a dense slip inside another mold removed from said container.

12. Device according to claim 11, wherein said conveyor means comprises a lifting means for lifting said closed mold and inserting said closed mold inside said container.

13. Device according to claim 12, wherein said lifting means includes a pantograph.

* * * * *

UNITED STATES PATENT AND TRADEMARK OFFICE

CERTIFICATE OF CORRECTION

PATENT NO. : 5,922,258
DATED : July 13, 1999
INVENTOR(S) : Renato Bossetti

It is certified that error appears in the above-indentified patent and that said Letters Patent is hereby corrected as shown below:

On the title page, item [73]:

In the Assignee: change "S.I.T.A. S.p.A. Societa Impianti Termoelettrici Industriali" to --S.I.T.I. S.p.A. Società Impianti Termoelettrici Industriali--

Signed and Sealed this

Sixth Day of March, 2001

*Attest:*

Nicholas P. Godici

NICHOLAS P. GODICI

*Attesting Officer*

*Acting Director of the United States Patent and Trademark Office*

UNITED STATES PATENT AND TRADEMARK OFFICE

CERTIFICATE OF CORRECTION

PATENT NO. : 5,922,258

DATED : July 13, 1999

INVENTOR(S) : Renato Bossetti

It is certified that error appears in the above-identified patent and that said Letters Patent is hereby corrected as shown below:

Column 2, line 31, change "coaxally" to -- coaxially --.

Signed and Sealed this

Twenty-fourth Day of April, 2001

*Attest:*

Nicholas P. Godici

NICHOLAS P. GODICI

*Attesting Officer*

*Acting Director of the United States Patent and Trademark Office*